United States Patent [19]

Faldt et al.

[11] Patent Number: 4,479,443

[45] Date of Patent: Oct. 30, 1984

[54] METHOD AND APPARATUS FOR THERMAL DECOMPOSITION OF STABLE COMPOUNDS

[76] Inventors: Inge Faldt, Tibbarps gard, S-267 00 Bjuv; Leif Bjorklund, Hudiksvallsgatan 7, S-252 51 Helsingborg, both of Sweden

[21] Appl. No.: 383,226

[22] Filed: May 28, 1982

Related U.S. Application Data

[63] Continuation-in-part of Ser. No. 359,665, Mar. 8, 1982, abandoned.

[51] Int. Cl.[3] ..... F23G 3/00

[52] U.S. Cl. ..... 110/346; 110/235; 110/237; 110/238

[58] Field of Search ..... 110/346, 235, 236, 237, 110/238

[56] References Cited

U.S. PATENT DOCUMENTS 3,328,277 6/1967 Schmidt et al. .
4,320,709 3/1982 Hladun ..... 110/237
4,359,005 11/1982 Baston ..... 110/347 X

FOREIGN PATENT DOCUMENTS 2425007 12/1975 Fed. Rep. of Germany .

OTHER PUBLICATIONS

Barton, "Problem Waste Disposal by Plasma Heating", Recycling Berlin, vol. 1, 1979.

*Primary Examiner*—Edward G. Favors
*Attorney, Agent, or Firm*—Finnegan, Henderson, Farabow, Garrett & Dunner

[57] ABSTRACT

A method and apparatus for thermal decomposition of stable substances, preferably chemical hazardous waste. The invention achieves a high decomposition temperature by giving the waste the necessary decomposition temperature through the use of a plasma generated in a plasma burner. The waste itself can be carried through a plasma generator. Alternately, part, or all of the waste can be mixed with the plasma in a reaction chamber where decomposition takes place. The carrier gas of the plasma can be given a temperature of 3000° to 4000° C., or under certain conditions even a higher temperature. The invention also includes additional steps to eliminate toxic gases that might form during the decomposition of the waste or the cooling of the resultant gases.

37 Claims, 2 Drawing Figures

METHOD AND APPARATUS FOR THERMAL DECOMPOSITION OF STABLE COMPOUNDS

BACKGROUND OF THE INVENTION

1. Field of the Invention

This is a continuation-in-part of U.S. application Ser. No. 359,665 which was filed on Mar. 8, 1982 abandoned.

The present invention relates generally to a method and apparatus for thermally decomposing hazardous wastes. In particular, the present invention is directed to a method and apparatus for thermally decomposing thermally stable and dangerous, hazardous, superhazardous, or otherwise toxic waste products, preferably chemical wastes, such as polychlorinated biphenyls (PCB), by subjecting the waste to a high temperature plasma generated by a plasma generator, preferably an electric plasma generator. The wastes may be either in solid, liquid, or gaseous form.

The typical feature of the new method is that the waste is given the necessary decomposition temperature by a plasma generated in a plasma burner or generator. The method uses in its operation the characteristics of the plasma to create extremely high temperatures in the carrier gas under highly varying redoxconditions. These properties are extremely advantageous in connection with the decomposition of the main part of so-called hazardous waste.

2. Description of the Prior Art

The group of chemical substances that are considered to be hazardous wastes consists of a wide variety of substances and product mixtures. Governmental authorities, including state and federal environmental agencies such as the Environmental Protection Agency, have designated numerous products under the category "hazardous wastes." These wastes must be properly treated to protect the environment and mankind.

The group of chemical substances that are considered hazardous wastes consist of product mixtures, for instance polychlorinated biphenyls (PCB), as well as more well-defined compounds like pentachlor phenol. The danger of these types of chemicals is related to the toxicity and stability of the included compounds. These compounds often are highly thermal stable compounds which are not easily decomposed. Further, whenever these compounds are decomposed, the resultant products and gases can create even more toxic wastes unless the decomposition process is highly controlled. The compounds themselves and any wastes coming from the compounds might easily migrate into the ecological system in an uncontrolled way when subjected to inferior decomposition processes.

The past methods and apparatus for treating these stable compounds of hazardous waste has been largely unsuccessful or uneconomical, or both. In standard thermal decomposition processes, the hazardous wastes are decomposed largely by the energy released from the burning of the hazardous waste. In the case of stable compounds such as PCB, however, the wastes have low calorific content and do not themselves produce sufficient energy to properly and fully decompose the highly stable hazardous wastes to stable and safe products.

In large rotary kilns, as for instance in the cement industry, it is possible to generate temperatures above 1200° C. during approximately 5 seconds. The rapid cooling properties from this temperature level are, however, disadvantageous, and therefore there is a significant risk that toxic compounds will synthesize during the cooling process. In addition, thermal stable compounds like dioxines cannot be properly decomposed in this type of kiln in view of the low temperatures and limited reaction times available.

In another system, there have been attempts to decompose PCB and similar stable compounds by bubbling a gaseous state of the compound through molten metal. This procedure, however, has not been successful since only the exterior portions of the bubble are directly heated by the metal, and often molecules in the interior of the bubble are not fully and safely decomposed in the process.

SUMMARY OF THE INVENTION

The object of the present invention is to provide a method and apparatus for the thermal decomposition of hazardous waste in either a liquid, gaseous, or a solid state. It is a further object to provide a method and apparatus which is particularly capable of converting thermally stable compounds, such as PCB, into simple and stable non-hazardous substances. Another object is to provide a method and apparatus for thermal decomposition of waste products which is readily adaptable to decompose a wide variety of waste products without major variation. A further object is to provide a method and apparatus in which the temperature at which the decomposition takes place can be directly controlled independently of the thermal properties of the waste.

Additional objects and advantages of the invention will be set forth in part in the description which follows, and in part will be obvious from the description, or may be learned by practice of the invention. The objects and advantages may be realized and obtained by means of the elements and combinations particularly pointed out in the appended claims.

To achieve the objects and in accordance with the purpose of the invention, as embodied and broadly described herein, the method of this invention comprises forming a reaction chamber directly at the outlet end of a plasma generator; producing a high temperature plasma in the plasma generator and introducing the plasma into the reaction chamber; introducing the hazardous waste into the reaction chamber; introducing sufficient oxidizing agents to the hazardous waste to permit the complete decomposition of the hazardous waste to stable final products; and controlling the temperature of the plasma and the flow of the hazardous waste so that the hazardous waste reaches a sufficiently high temperature for a sufficient period of time to thermally decompose completely to stable final products.

To achieve further the objects and in accordance with the purpose of the invention, as embodied and broadly described herein, the apparatus of this invention comprises a plasma generator for producing a high temperature plasma; a reaction chamber connected at the output end of the plasma generator for receiving the high temperature plasma and the hazardous waste, the reaction chamber being designed to produce a mixture in which all molecules of the hazardous waste reach at least a minimum desired temperature; means for feeding hazardous waste to said reaction chamber; means for feeding sufficient oxidizing agents to said hazardous waste to permit the complete decomposition of the waste to stable final products, and means for controlling the temperature of the plasma and the flow of the hazardous waste so that the hazardous waste can reach a sufficiently high temperature for a sufficient period of time to thermally decompose completely to stable final products.

The method and apparatus of the invention overcome the problems and disadvantages of the prior art by providing a method and apparatus which permits the complete decomposition of thermally stable compounds such as PCB. Additionally, the temperature at which the wastes are decomposed can be controlled independent of the thermal properties of the wastes since the resultant temperature of the wastes being decomposed is a function of the energy applied to an electric plasma generator. The flow of the waste can be controlled through the use of valves and pumps, as will be apparent to one skilled in the art. Also, the present invention subjects all of the hazardous wastes to a complete mixing to ensure that the entire hazardous waste substance is properly and completely decomposed.

It is understood that both the foregoing general description and following detailed description are exemplary and explanatory only and are not restrictive of the invention, as claimed.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Figure 1:
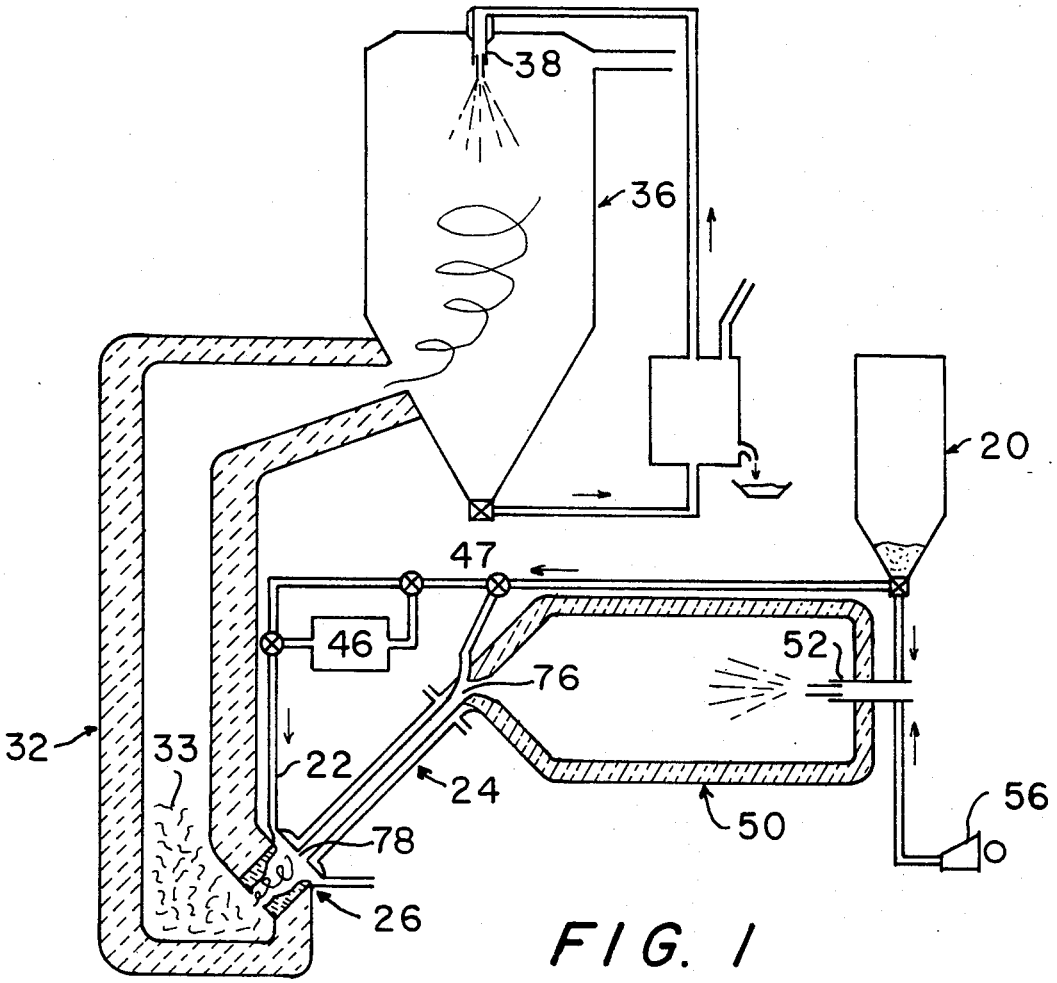
FIG. 1 is a schematic diagram illustrating an embodiment of the present invention.

Reference will now be made in detail to the present preferred embodiments of the invention, examples of which are illustrated in the accompanying drawings.

At thermal decomposition, i.e., at a severe heating under oxidative decomposition, it is predominantly the thermal stability of the compounds that determines the efficiency of the decomposition. In general, four primary process parameters should be controlled and balanced in order to obtain an acceptable decomposition of hazardous waste. As will be explained in detail below, only a plasma system can properly control each of these four factors.

The temperature must be sufficiently high during a sufficiently long period of time in order to achieve a decomposition of the various compounds. These temperatures must be normally over 1100° C., and for very toxic dioxines a minimum temperature of 1200° C. must be maintained for approximately 20 seconds. The time required to decompose compounds, however, decreases significantly as the temperature at which the decomposition takes place increases.

The reaction time must almost always be linked to the temperature. While a higher temperature can compensate for a shorter reaction time, nevertheless, a compound must be subjected to a given temperature for a sufficient time to decompose all molecules of the compound. Therefore, in a continuous flow process, the flow pattern of the compound and the reaction time of the elements in the flow must be considered.

The oxidation potential must be sufficiently high to permit the decomposition of the compound to stable final products such as $CO_2$, $H_2O$, and HCl in order to prevent a pyrolysis of different chemicals due to the lack of oxygen. An absence of sufficient oxygen or oxidizing agents in a decomposition system will result in the formation of highly reactive gaseous species. Because of the risk of chlorine formation at a high oxidation potential, it may be suitable to choose a high temperature and a lower oxidation potential environment which will tend to promote the formation of HCl rather than free chlorine.

The neutralization capability for formed hydrochloric acid is a factor of strength which tends to suppress the formation of chlorine during a decomposition process. Chlorine, unless suppressed through neutralization, has a tendency to act as a catalyst and promote the formation of toxic compounds as the temperature of the decomposed material decreases. Therefore, unless chlorine is eliminated, the decomposition of one hazardous waste may produce ultimately more hazardous and toxic waste.

The present existing technology to achieve the decomposition efficiency required by environmental control authorities does not provide acceptable control regarding the aforementioned process parameters. Generally, the techniques used today can handle one or two of the critical parameters only.

Another fact that must be considered is the necessary reaction time. The reaction time necessary to achieve complete thermal decomposition of a hazardous waste is dependent upon a variety of factors. Some authorities refer to the expressions residence time or in the best case mean residence time. In thermal decomposition processes, however, these terms are irrelevant. For instance, saying that the actual process residence time is sufficient for a certain requirement may be meaningless. The only relevant time expression is the shortest residence time of any element in the flow. In most cases, a residence time distribution of a certain shape applies to a particular system due to the flow characteristics of the system, and for a particular time distribution there exists a shortest residence time to achieve complete decomposition of the flow. The residence time of the invention must be at least as great as this shortest residence time, and preferably should be longer to provide a safety factor. If, for instance, 1% of the gas volume has a residence time shorter than the critical reaction time to bring about, for instance, a decomposition of 99.99%, it is of very little value if the mean residence time is 100% or even 1000% in excess of the critical one because the integral decomposition will only be slightly over 99% and not 99.99%. This fact points out the necessity of having a system which can work independently of the calorific value of the waste product in order to easily assimilate the critical reaction time and its related process to guarantee the minimum reaction time of the system.

Generally, the existing techniques of decomposition of waste cannot bring about a necessary temperature/residence time profile for actual decomposition requirements.

The method and apparatus of the present invention eliminates all of the above-named weaknesses. The plasma burner or plasma generator 24 of the present invention can heat the passing gas or fluid to 3000° to 4000° C. or higher and can depending on the properties of the waste and other process requirements be placed at different locations in the process. The temperature of the plasma produced by a plasma generator is controlled by varying the electrical energy applied to the generator. The present invention utilizes the heating and mixing capabilities of a plasma generator to provide an improved decomposition method and apparatus.

Figure 2:
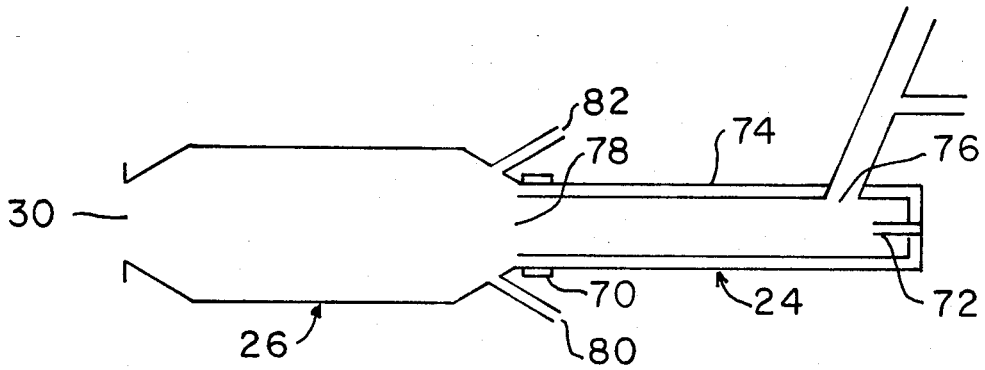
FIG. 2 is a sectional view of the plasma generator and reaction chamber of the present invention illustrating those elements in more detail than that shown in FIG. 1.

As shown in FIG. 1, the apparatus of the present invention includes a plasma generator 24 and a reaction chamber 26. The plasma generator 24 and reaction chamber 26 are shown in more detail in FIG. 2 which will be described herein. Plasma generators such as generator 24 are commercially available and are electrically powered. Such a plasma generator includes a cathode 70 and an anode 72 and normally includes water-cooled copper walls 74. The plasma generator shown in FIG. 2 is a cylindrical shape and includes an inlet 76 and an outlet 78. Generally, a plasma generator can heat a gas to extremely high temperatures in the range of 3000° to 10,000° C. at which temperature the gas is ionized and converted into a plasma. Plasma generators provide high energy intensity and simple and precise control. The plasma generator produces a high temperature plasma which exits at outlet 78. Currently, there are ten megawatt plasma generators available on the market, and larger plasma generators are in the design and testing stage. It is preferred that the plasma generator be of a cylindrical type which in commercial embodiments of today have diameters varying from fractions of an inch to several inches. These plasma generators can provide a plasma in which all molecules introduced into the generator and converted into the plasma reach a desired high decomposition temperature. The amount of energy that can be added to the gas are extremely large, and can amount to 10K Wh/$Nm^3$. By knowing the characteristics of a particular waste to be decomposed, one can calculate the amount of energy necessary to decompose the waste. Calculations generally show that approximately one ton of waste material per hour per megawatt can be decomposed in a plasma generator.

The process stream, usually in a fluid state, is introduced to the plasma generator at inlet 76. As will be described in more detail below, that fluid can include a carrier gas, recirculated exhaust gas, and even all or part of the hazardous waste in a liquid or gaseous state. It is also possible to introduce solid particles of the waste product at the inlet 76 of the plasma generator. However, those particles might adhere to the copper walls 74 of the generator 24, and therefore in the preferred embodiment of the invention solid particles are introduced at or about the exit end 78 of the plasma generator 24.

The reaction chamber 26 is directly connected to the outlet 78 of the plasma generator 24. That reaction chamber is well insulated so that little heat is lost through the chamber walls. In addition to receiving the plasma from the plasma generator, the reaction chamber 24 can receive a neutralizing agent through inlet 80. In addition, if desired, solid particles or other forms of hazardous waste can be introduced at inlet 82 which is positioned immediately adjacent the output end of plasma generator 24. Finally, sufficient oxidizing agents should be introduced to the system to allow the complete decomposition of the hazardous materials introduced to the plasma generator and reaction chamber. Oxidizing agents, such as oxygen, air and other well-known materials, can be introduced through the inlet 76 of the generator 24, through the inlets 80 and 82 of the chamber 26, or through the combination of each. Further, oxidizing agents can be introduced to the hazardous waste as they leave the reaction chamber 26. A separate inlet oxidizing agent can be used, if desired.

The reaction chamber 26 should be designed to achieve a complete mixing of the plasma generated by the plasma generator 24 and any materials or substances introduced at inlets 80 and 82. All materials within that reaction chamber should reach at least a desired minimum decomposition temperature. The reaction chamber should hold the mixed hazardous waste for a sufficient period to allow thermal decomposition of a significant portion of hazardous waste. In some embodiments of the invention, the reaction chamber should hold the hazardous waste long enough to ensure that all portions of the hazardous waste are completely decomposed. In other embodiments a post-combustion chamber at the outlet of the reaction chamber may be used to complete the decomposition of the hazardous waste. While it may prove necessary to design a special reaction chamber 26 for decomposing a specific hazardous waste, it is believed that one or a few interchangeable chambers designed through empirical analysis will provide a working system for most hazardous wastes.

The present invention provides a variety of solutions to decompose waste products. One solution is to evaporate or disburse the waste into the carrier gas initially in a separate unit by well-known techniques. The carrier gas with its dispersed contents of waste can then be introduced into the plasma generator at inlet 76 and heated to a suitable temperature. This heating can be achieved without any combustion by subjecting the waste to the plasma generator 24 in the absence of a sufficient amount of air, oxygen enriched air or pure oxygen. Then the amount of oxygen necessary for the complete oxidation decomposition of the waste can be added in the most suitable form immediately after the plasma flame in the reaction chamber 26. As the particular process requires, different temperature patterns can be achieved. Alternately, it is also possible to add all of the needed combustion air and oxygen in the fluid introduced at inlet 76 of plasma generator 24 to achieve the plasma.

Another variety of the process can be to pretreat the waste by utilizing for instance an advanced technique or some other less efficient technique in a separate unit and then use the plasma generator only as a super heater to heat and maintain the plasma and waste products at the necessary temperature/reaction time of the desired decomposition.

In connection with the treatment of solid wastes, the most suitable process appears to be to inject the material together with a minimum amount of carrier gas immediately after the plasma burner. Preferably, the solid waste is introduced in fine particle size to ensure complete decomposition.

Reference is now made to FIG. 1 to describe additional elements and embodiments of the invention. In almost all cases of the decomposition of hazardous wastes, it is preferable to keep the combustion gases at a high temperature for 1 to 10 seconds after the gases exit from the plasma burner 24 and the connected reaction chamber 26 to ensure the decomposition and appropriate controlled transformation of the plasma to gas. This operation can preferably be performed in a combustion chamber 32 connected directly to the reaction chamber 26 at its outlet orifice 30. Preferably the combustion chamber 32 is formed from a ceramic-lined shaft and can be either be empty or contain some arrangement of a heat resistant filling shown generally as 33 in order to achieve a desired flow pattern with the ultimate intention being to achieve a true minimum residence time (reaction time). The ability of certain metal compounds to accelerate the decomposition of organic compounds is known. Therefore, so-called decomposition catalysts can be mixed into the heat resistant filling 33 of the final combustion chamber 32. Also, if the treated wastes, as frequently occurs, contain chlorine or other halogens as for instance flourine and so-called freons, it may be very essential to bind the chlorine as for instance calcium chloride as much as possible. This can be achieved in a simple way by adding calcium hydrate, lime, or limestone or other active neutralizing agents at a suitable process step. This energy consuming operation can in connection with a plasma process be placed within the process in a more free way then in connection with other techniques not capable of generating the same energy density.

Also, if the problem to counteract the secondary formation of hazardous organic substances at the cooling of the combustion gases is not primarily linked to the method of decomposition of the main waste by generating a high temperature, it is suitable to design an integrated process with plasma super heating as the key operation.

It is important that the final combustion chamber 32 be highly insulated and designed so that the gases within the chamber always maintain a temperature sufficiently high to prevent the formation of toxic wastes during the cooling of the gases. Many gases in the range of 300° to 900° C. can easily synthesize into highly toxic substances. Preferably, the chamber 32 is designed to ensure temperatures in the 1200° C. range.

The combustion gases must ultimately be cooled so that they can be released into the environment. A rapid cooling of the combustion chambers is preferably performed with a tubular cooler or scrubber 36 located beside the decomposition unit. Cooler 36 includes a flash device 38 which produces a slurry of finely divided particles of a neutralization agent to cool the gases. For most hazardous waste gases, it would be preferable to cool the gases exhausted from chamber 36 to less than 300° C. in less than a second.

The developed method according to the invention to decompose primarily so-called hazardous wastes can be performed in a furnace that for instance can be designed in the manner as presented in the attached drawing at FIG. 1.

If the decomposition of very stable compounds (that the invention is very well adapted to) is occurring at varying degrees in the whole temperature zone, the main portion of the decomposition may preferably take place in reaction chamber 26 into which primarily the high temperature plasma is introduced. Depending upon the properties of the waste, part of or the whole amount of the waste can be added to the reaction chamber 26 through feed pipe 22 from a waste container 20, or in the case of an eventual necessary pretreatment from the corresponding pretreatment equipment 46. The pretreatment equipment 46 would vary depending upon the waste and could include grinders, preheaters, evaporators, and similarly known pretreatment devices to give the waste a form and consistency suitable for decomposition. For some waste, it may be preferable to feed the waste directly to the plasma generator 24 by line 47.

Another efficient and possible manner of preparing the wastes for either the overheating/pyrolysis or for the combustion in the plasma unit and/or reaction chamber is to evaporate it in an evaporating unit 50 in which a flash burner 52 such as an atomizer or an efficient burner mixes combustion air from compressor 56 and hazardous waste from waste container 20.

Also, when compounds of hazardous wastes have largely been decomposed to a sufficient degree by the very high temperature of the reaction chamber, due to the toxicity of the trace amounts it may be necessary or preferable to further expose the exhaust gases to high temperature so that a formation of toxic substances will not occur. Combustion chamber 32 serves this need.

The combustion gases in the combustion chamber should be connected to a device for rapid cooling. Presently, it appears that the use of an efficient quasi-dry scrubber 36 with a neutralizing slurry as a coolant will be the best alternative to cool the exhaust gases rapidly enough to avoid the formation of toxic or generally unwanted substances. The neutralizing product that has trapped the major portions of the hydrochloric acid, hydrofluoric acid or other acid products formed at combustion, can, if desired, be partly recirculated through the system after bleeding away a certain quantity. This regulation, like the addition of makeup water and the slurry preparation, are apparent operations to a person skilled in the art and are marked according to their location in the flow sheet at the unit 64.

As mentioned earlier in the presentation, the neutralizing agent can eventually be added in the reaction chamber or immediately after it. It is primarily the temperature and melting properties of the neutralization product that are governing this operation performance.

It is important that the system of the present invention be controlled and regulated. Since a pilot process of the present invention has not been designed, the exact parameters of the system for a particular waste product or products have not been determined. The system would necessarily include feed pumps and valves to control the flow of the various materials through the system. It is contemplated that the system would include sensing devices for sensing the flow rate and temperature of the materials within the system. It is further contemplated that temperature sensing devices such as pyrometers would be located at the inlet 76 of the plasma generator 24, the outlet 78 of that plasma generator, the outlet 30 of the reaction chamber 26, the center of the combustion chamber 32, the outlet of the combustion chamber 35, and the center of the supercooling unit 36. The system also would include flow meters, gas testors, and similar sensing devices known in the waste decomposition art. Finally, it would be necessary to control the temperature of the plasma and the flow of the hazardous waste so that the hazardous waste would reach a sufficiently high temperature for a sufficient period of time to thermally decompose completely to stable products.

The viscosity of gases increases at approximately 1500° C., and therefore the plasma produced by the plasma generator acts much like a liquid. As the temperature of the plasma increases, it is more difficult for the oxygen molecules to react with the plasma. Therefore, it is often preferred to operate the system at the lowest temperature which still safely decomposes all the waste material in the chamber.

At times, it may be desirable to recirculate the exhaust gases through the system to ensure that 100% decomposition has taken place. If desired, sensing means can be utilized to sense the possible existence of toxic gases and materials and control this loop process. In addition, it is contemplated that at least some of the exhaust gases and be recirculated as carrier gases. Also, it may be desirable to use several plasma generators in a particular system. At times it may be beneficial to direct the flow of several plasma burners to a single reaction chamber. The placing of several plasma burners, and possibly several reaction chambers, in an end-to-end series relationship is also contemplated.

For simple hazardous waste, the waste can be directly introduced to the plasma generator where the waste can be completely decomposed in a single operation. In such an operation, the reaction chamber 26, combustion chamber 32, and cooler 36 would be unnecessary. For other waste, it may be possible to achieve complete decomposition after passing the waste through the plasma generator and the reaction chamber. Still other more complex waste may not be finally and completely decomposed until the waste passes through the plasma generator, reaction chamber, and final combustion chamber. For certain waste, it may be necessary to recirculate the waste through the process one or more times to achieve the desired decomposition. In all operations, it is preferable to include neutralizing agents in one or more steps of the process and to rapidly cool the exhaust gases to eliminate the formation of toxic secondary products.

For the worst cases of wastes, such as PCB in a solid form, additional pretreatment procedures might be necessary. For instance, if PCB waste is in solid form in a drum in its initial stage, it might be necessary to place the drum in a tunnel kiln and place a heating lance directed into the drum. The heating lance at approximately 1400° C. woulc evaporate all the PCB within the drum and the evaporated PCB and partially combusted gases could then be introduced to the plasma generator or reaction chamber.

Waste with a very high Btu rating might also benefit from a pretreatment step since that step will enable the waste to be more quickly and easily oxidized in the plasma generator and the reaction chamber. Similarly, solid waste generally should be transferred into small particles before being introduced to the system.

Obviously, many modifications and variations of the present invention are possible in light of the above teachings. Thus, it is intended that the present invention cover the modifications and variations of the invention provided they come within the scope of the appended claims and their equivalents.

What is claimed is:

1. A method for the thermal decomposition of hazardous waste comprising the steps of:

introducing the hazardous waste into the input end of a plasma generator;

producing a high temperature plasma in the plasma generator;

subjecting the hazardous waste to sufficient oxidizing agents to permit the complete thermal decomposition of the hazardous waste to stable products; and controlling the temperature of the plasma and the flow of the hazardous waste so that the hazardous waste reaches a sufficiently high temperature for a sufficient period of time to thermally decompose completely to stable final products.

2. The method of claim 1 further comprising the step of pretreating the hazardous waste to give it a consistency suitable for decomposition.

3. The method of claim 2 wherein the pretreatment step includes a thermal preheat treatment resulting in a partial decomposition of said hazardous waste.

4. The method of claim 2 wherein the pretreatment step includes the step of modifying solid hazardous waste to give the waste a consistency suitable for introduction into said plasma generator.

5. The method of claim 1 further comprising the step of introducing to said plasma generator a neutralization agent.

6. The method of claim 1 further comprising the step of rapidly cooling the gases exhausted from said plasma generator to avoid the formation of toxic substances during the cooling of said gases.

7. An apparatus for the thermal decomposition of hazardous waste comprising:

a plasma generator for producing a high temperature plasma in which all molecules of the plasma reach at least a desired minimum temperature;

means for feeding hazardous waste to and through said plasma generator;

means for feeding sufficient oxidizing agents to said hazardous waste to permit the complete decomposition of the hazardous waste to stable products; and means for controlling the temperature of the plasma and the flow of hazardous waste through said plasma generator so that the hazardous waste can reach a sufficiently high temperature for a sufficient period of time to thermally decompose completely to stable final products.

8. The apparatus of claim 7 further comprising means for feeding a neutralizing agent to said hazardous waste.

9. The apparatus of claim 7 further comprising a primary cooling chamber connected to said plasma generator for receiving the exhaust gases from said plasma generator and rapidly supercooling the gases.

10. The device of claim 8 further comprising a combustion chamber connected to the output of said plasma generator for accepting the exhaust from said plasma generator and holding the expanded gases at a sufficiently high temperature to prevent the formation of toxic gases, and a primary cooling chamber connected to said combustion chamber for receiving the exhaust gases of said combustion chamber and rapidly supercooling the gases.

11. A method for the thermal decomposition of hazardous waste comprising the steps of:

forming a reaction chamber directly at the outlet end of a plasma generator;

producing a high temperature plasma in the plasma generator and introducing said plasma into the reaction chamber;

introducing hazardous waste into the reaction chamber through the plasma generator;

subjecting the hazardous waste to sufficient oxidizing agents to permit the complete decomposition of the hazardous waste to stable products; and controlling the temperature of the plasma and the flow of the hazardous waste so that the hazardous waste reaches a sufficiently high temperature for a sufficient period of time to thermally decompose completely to stable final products.

12. A method for the thermal decomposition of hazardous waste comprising the steps of:

forming a reaction chamber directly at the outlet end of a plasma generator;

producing a high temperature plasma in the plasma generator and introducing said plasma into the reaction chamber;

subjecting the hazardous waste to a thermal preheat treatment resulting in a partial decomposition of said hazardous waste;

introducing the hazardous waste into the reaction chamber at a point proximate to the output end of the plasma generator;

subjecting the hazarous waste to sufficient oxidizing agents to permit the complete decomposition of the hazardous waste to stable products; and controlling the temperature of the plasma and the flow of the hazardous waste so that the hazardous waste reaches a sufficiently high temperature for a sufficient period of time to thermally decompose completely to stable final products.

13. The method of claim 12 wherein some hazardous waste is introduced into the reaction chamber through the plasma generator.

14. A method for the thermal decomposition of hazardous waste comprising the steps of:

forming a reaction chamber directly at the outlet end of a plasma generator;

producing a high temperature plasma in the plasma generator and introducing said plasma into the reaction chamber;

introducing the hazardous waste into the reaction chamber at a point proximate to the output end of the plasma generator;

recircling some gas exhausted from said reaction chamber into a member of the group consisting of the plasma generator and the reaction chamber;

subjecting the hazardous waste to sufficient oxidizing agents to permit the complete decomposition of the hazardous waste to stable products; and controlling the temperature of the plasma and the flow of the hazardous waste so that the hazardous waste reaches a sufficiently high temperature for a sufficient period of time to thermally decompose completely to stable final products.

15. A method for the thermal decomposition of hazardous waste comprising the steps of:

forming a reaction chamber directly at the outlet end of a plasma generator;

producing a high temperature plasma in the plasma generator and introducing said plasma into the reaction chamber;

introducing the hazardous waste into the reaction chamber at a point proximate to the output end of the plasma generator;

feeding the exhaust gases of the reaction chamber to a combustion chamber designed to hold the expanding gases at a temperature sufficiently high to prevent the formation of toxic gases in said chamber, said combustion chamber having a heat resistant filling to improve the residence time distribution of the exhaust gases and wherein decomposition catalyzing substance is applied on the filling of the combustion chamber;

subjecting the hazardous waste to sufficient oxidizing agents to permit the complete decomposition of the hazardous waste to stable products; and controlling the temperature of the plasma and the flow of the hazardous waste so that the hazardous waste reaches a sufficiently high temperature for a sufficient period of time to thermally decompose completely to stable final products.

16. A method for the thermal decomposition of hazardous waste comprising the steps of:

forming a reaction chamber directly at the outlet end of a plasma generator;

producing a high temperature plasma in the plasma generator and introducing said plasma into the reaction chamber;

introducing the hazardous waste into the reaction chamber at a point proximate to the output end of the plasma generator;

feeding the exhaust gases of the reaction chamber to a combustion chamber designed to hold the expanding gases at a temperature sufficiently high to prevent the formation of toxic gases in said chamber;

exhausting the gases from the combustion chamber into a super cooler wherein the exhaust gases are subjected to a sufficient slurry of finely divided particles of neutralization agents to cool the gases below 350° in less than a second and to reduce the hydrogen halogenids in the exhausted gases;

subjecting the hazardous waste to sufficient oxidizing agents to permit the complete decomposition of the hazardous waste to stable products; and controlling the temperature of the plasma and the flow of the hazardous waste so that the hazardous waste reaches a sufficiently high temperature for a sufficient period of time to thermally decompose completely to stable final products.

17. An apparatus for the thermal decomposition of hazardous waste comprising:

a plasma generator for producing a high temperature plasma;

a reaction chamber connected directly at the output end of the plasma generator for receiving the plasma and hazardous waste, said reaction chamber being designed to produce a mixture in which all molecules of hazardous waste reach at least a desired minimum temperature;

means for feeding hazardous waste to said reaction chamber at a point proximate to the output end of the plasma generator, said means including a pipe connected to the input of said plasma generator;

means for feeding sufficient oxidizing agents to said hazardous waste to permit the complete decomposition of said hazardous waste to stable final products; and means for controlling the temperature of the plasma and the flow of the hazardous waste so that the hazardous waste can reach a sufficiently high temperature for a sufficient period of time to thermally decompose completely to stable final products.

18. An apparatus for thermal decomposition of hazardous waste comprising:

a plasma generator for producing a high temperature plasma;

a reaction chamber connected directly at the output end of the plasma generator for receiving the plasma and hazardous waste, said reaction chamber being designed to produce a mixture in which all molecules of hazardous waste reach at least a desired minimum temperature;

means for feeding hazardous waste to said reaction chamber at a point proximate to the output end of the plasma generator;

a combustion chamber connected to the output of said reaction chamber for accepting the exhaust from said reaction chamber and holding the expanded gases at a sufficiently high temperature to prevent the formation of toxic gases;

a primary cooling chamber connected to said combustion chamber for receiving the exhaust gases of said combustion chamber and rapidly supercooling the gases;

a device within the primary cooling chamber for spraying a neutralizing slurry over the gases exhausted from said combustion chamber;

means for recirculating exhaust gases from primary cooling chambers to said reaction chamber;

means for feeding sufficient oxidizing agents to said hazardous waste to permit the complete decomposition of said hazardous waste to stable final products; and means for controlling the temperature of the plasma and the flow of the hazardous waste so that the hazardous waste can reach a sufficiently high temperature for a sufficient period of time to thermally decompose completely to stable final products.

19. The apparatus of claim 1 wherein decomposition catalyst substances are applied onto a filling of the combustion chamber.

20. The apparatus of claim 1 further comprising a pretreatment unit including an atomizing unit for preheating and evaporating the hazardous waste.

21. The method of claim 11 further comprising the step of pretreating the hazardous waste to give it a consistency suitable for decomposition before introducing it into said reaction chamber.

22. The method of claim 12 wherein the pretreatment step includes the step of modifying solid hazardous waste to give the waste a consistency suitable for introduction into said reaction chamber.

23. The method of claim 11 further comprising the step of introducing to said reaction chamber a neutralization agent.

24. The method of claim 23 wherein the neutralizing agent is selected from the group consisting of lime, sodium compounds, calcined lime, and calcium hydrate.

25. The method of claim 11 further comprising the step of feeding the exhaust gases of the reaction chamber to a combustion chamber designed to hold the expanding gases at a temperature sufficiently high to prevent the formation of toxic gases in said chamber.

26. The method of claim 25 wherein the exhaust gases within the combustion chamber are kept well above 900° C.

27. The method of claim 25 wherein the exhaust gases within the combustion chamber are kept at between 1100° and 1200° C.

28. The method of claim 15 further comprising the step of rapidly cooling the gases exhausted from said combustion chamber to avoid the formation of toxic substances during the cooling of said gases.

29. The method of claim 28 wherein the gases are rapidly cooled to a temperature below 350° C.

30. The method of claim 29 further comprising the step of reducing the content of hydrogen halogenids in the exhaust gases from the combustion chamber by exposing the exhaust gases to a neutralization agent.

31. The apparatus of claim 17 wherein the means for feeding hazardous waste and oxygen includes a pipe connected to said reaction chamber.

32. The apparatus of claim 17 further comprising means for feeding a neutralization agent to said reaction chamber.

33. The apparatus of claim 17 further comprising a combustion chamber connected to the output of said reaction chamber for accepting the exhaust from said reaction chamber and holding the expanded gases at a sufficiently high temperature to prevent the formation of toxic gases.

34. The apparatus of claim 33 wherein the combustion chamber has a filling to improve the residence time distribution of gases flowing through the combustion chamber.

35. The apparatus of claim 17 further comprising a pretreatment unit to give the hazardous waste a consistency suitable for decomposition before introducing it to said reaction chamber.

36. The apparatus of claim 33 further comprising a primary cooling chamber connected to said combustion chamber for receiving the exhaust gases of said combustion chamber and rapidly supercooling the gases.

37. The apparatus of claim 36 wherein the primary cooling chamber includes a device for spraying a neutralizing slurry over the gases exhausted from said combustion chamber.

* * * * *

UNITED STATES PATENT AND TRADEMARK OFFICE

CERTIFICATE OF CORRECTION

PATENT NO. : 4,479,443

DATED : October 30, 1984

INVENTOR(S) : Inge Faldt et al.

It is certified that error appears in the above-identified patent and that said Letters Patent is hereby corrected as shown below:

Claim 19, col. 13, line 1, change "1" to --33--.

Claim 20, col. 13, line 1, change "1" to --33--.

Signed and Sealed this

*Thirtieth* Day of *April 1985*

[SEAL]

*Attest:*

DONALD J. QUIGG

*Attesting Officer*

*Acting Commissioner of Patents and Trademarks*